United States Patent [19]

Inoue

[11] 4,005,956

[45] Feb. 1, 1977

[54] POWDER ACTIVATION AND INTEGRATED POWDER METALLURGY SYSTEM

[75] Inventor: Kiyoshi Inoue, Tokyo, Japan

[73] Assignee: Inoue-Japan Research Inc., Yokohama, Japan

[22] Filed: Oct. 21, 1975

[21] Appl. No.: 624,431

Related U.S. Application Data

[60] Continuation-in-part of Ser. No. 350,162, April 11, 1973, Pat. No. 3,932,760, which is a division of Ser. No. 60,070, July 31, 1970, Pat. No. 3,738,828, which is a continuation-in-part of Ser. No. 692,960, Dec. 22, 1967, Pat. No. 3,598,566.

[30] Foreign Application Priority Data

| | | |
|---|---|---|
| Oct. 22, 1974 | Japan | 49-121710 |
| Nov. 30, 1974 | Japan | 49-137857 |
| Dec. 2, 1974 | Japan | 49-139229 |

[52] U.S. Cl. ..... 425/78; 425/405 R; 425/174.2; 425/174.4; 75/211; 250/492 R; 250/431; 250/432 R

[51] Int. Cl.[2] ..... B30B 11/02

[58] Field of Search ..... 425/78, 405 R, DIG. 35, 425/174.2, 174.4; 75/211; 250/492, 251, 431, 432

[56] References Cited

UNITED STATES PATENTS

| | | | |
|---|---|---|---|
| 3,303,533 | 2/1967 | King | 425/78 |
| 3,343,209 | 9/1967 | Solomir et al. | 425/405 R X |
| 3,521,326 | 7/1970 | Rice et al. | 425/78 |
| 3,832,107 | 8/1974 | Cox et al. | 425/405 R X |

*Primary Examiner*—J. Howard Flint, Jr.
*Attorney, Agent, or Firm*—Owen, Wickersham & Erickson

[57] ABSTRACT

Activation of metallic powders by subjecting the powder to bombardment with electrons, ions, or molecules in an inert or reductive atmosphere. Improved densities result in sintering, as do improved catalytic actions. Simultaneous pulverization of coarse particles or bodies is also achieved where desired. The pretreatment is, in some instances, combined with loading the activated particles directly into a mold, for compaction or sintering, preferably with some additional activation, all done in an integrated system. The corpuscular particle bombardment of powder is advantageously effected by exposing the powder to a glow discharge produced between a pair of electrodes in a rarefied non-oxidizing atmosphere with the pressure of the atmosphere and the distance between the electrodes being such that their product in mm Hg times cm is in a range between $10^{-2}$ and 10.

22 Claims, 10 Drawing Figures

POWDER ACTIVATION AND INTEGRATED POWDER METALLURGY SYSTEM

This application is a continuation-in-part of my copending application Ser. No. 350,162, filed Apr. 11, 1973 (now U.S. Pat. No. 3,932,760) as a division of my application Ser. No. 60,070 filed July 31, 1970 (now U.S. Pat. No. 3,738,828) as a continuation-in-part of my application Ser. No. 692,960 filed Dec. 22, 1967 (now U.S. Pat. No. 3,598,566).

This invention relates to metallic powder activation. More particularly, it relates to an improved apparatus for the removal of impurities such as oxide film and moisture, as well as other contamination, from the surfaces of discrete metallic particles by utilizing impact energy. The result is to modify such surfaces to an activated powder that may be used for cold or warm pressing to form densified green compacts or for hot pressing to produce coherent sintered objects or for interparticle chemical reactions or for catalyst.

Conventionally, two powder activation processes have been available: (a) heating in a reductive atmosphere and (b) reaction with particular chemical agents. Each of these processes has had only limited efficiency.

The present invention comprises introducing powder into an inert or reductive atmosphere and there subjecting it to bombardment with high-energy impact force by electrons, ions, or molecules or combinations thereof.

Electron and ion bombardment for purposes of this invention may be effected through an electrical space discharge, e.g., corona or glow discharge, created through the inert or reductive medium between a pair of electrodes or among adjacent or close discrete particles fluidized in the inert or reductive medium. Molecular bombardment, probably with some accompanying ion bombardment, may be accomplished by shock waves, such as result from detonation in a shock gun, as by spark generation of impulses.

I have discovered that the electron, ion or molecular bombardment advantageously removes oxide films, moisture, adsorptive gaseous particles and other impurities normally firmly adherent to and coated on the substrate of each discrete particle, apparently by decomposing these impurities into gaseous substances, thereby cleaning the surfaces of the particles. In addition to removal of the coated films by the action of such bombardment, marked increases of surface tension and free energy of the cleaned surfaces are achieved as a result of the formation of strain and distortion. By continuous circulation of the inert or reductive medium, i.e., its replenishment by introducing fresh inert or reductive gas into and evacuating the contaminated atmosphere from the treatment chamber in which the bombardment is effected, the decomposed gaseous impurities are prevented from recombining with the material forming the particle substrate.

In addition to removal of the coated films, marked increases of surface tension and free energy of the cleaned surfaces are achieved, and this action is especially remarkable with ions or heavy particles of suitably regulated energy. Thus, the beam particles act as high-energy impact media and strike atoms at the surface region of each particle substrate, and by scattering they thereby produce strain and distortion in the powder particles without fusion.

The power supply for the production of effective corona and glow discharge may be a source of DC, AC, DC-pulse or pulsating current. Experimentation has demonstrated that a high-frequency and unidirectional current is preferable in promoting powder activation. An electron beam or ion beam gun may be employed.

For many applications, it is preferred to use a beam of ions (i.e., heavy particles or particles of atomic or molecular size and mass) as a corpuscular beam for impact powder activation.

The invention is applicable not only to metal powders and to powders of metal alloys, but also, in some aspects to powdered metal oxides, other metallic comounds, and also to non-metals such as carbon.

A highly activated powder, which exhibits excellent performance in metallurgical, chemical or electrochemical utilization (i.e., in terms of metallurgical bonbability, physical properties, chemical or electrochemical activity) is obtained by bombardment of corpuscular particles, especially ions or particles at least in part formed by ions, particles of atomic or molecular size and mass, which when they are imparted impact energy sufficient to form lattice defects (e.g., of Frenkel type) and accompanying lattice dislocations in the individual particles of powder.

In accordance with another aspect of the invention, simultaneously with activation, pulverization of relatively large-sized particles or bodies (wire, block, etc.) into smaller sized particles can be effected by means of impulses of discharge energy. For this purpose, fluidized powder may be held between a pair of electrodes in a non-oxidizing atmosphere so as to be subjected to interparticle discharges of impulsive character under the external application of a succession of impulses across the electrodes. Alternatively, a spark gap of relatively small spacing may be surrounded by floating powder so that upon the generation of impulse discharge at the gap, mechanical collisions may be induced among particles and propagated radially out from the spark gap. The particle size resulting from such pulverizing may be controlled by regulation of the discharge energy.

The present invention also provides an improved powder loading system wherein powder is pre-treated as described above, and is thereafter immediately loaded in a mold for compaction or sintering. Such a system offers the opportunity for further bombardment and purification during loading.

I have further discovered that the powder bombarding treatment by corpuscular particles, especially by energistic ions through glow discharge is improved in efficiency and uniformity of processing when the distance between the discharge electrodes $d$ and the pressure of the non-oxidizing atmosphere $p$ in which the discharge is effected are controlled such that their product $p \cdot d$ in mm Hg times cm is in a range between $10^{-2}$ and 10. The pressure $p$ may be in a range between $10^{-3}$ and 10 mm Hg and is preferably in a range between $10^{-2}$ and 10 mm Hg.

Thus, in my improved powder activation system, metallic powder is introduced in a gas-tight chamber receiving a rarefied inert or reductive gaseous atmosphere of a pressure in the range indicated and is received on a conveyer therein which carries the powder through a treatment zone at which glow discharge electrodes are located and juxtaposed. The inter-electrode distance $d$ is adjusted so as to satisfy the relationship indicated. The conveyer may be a moving belt or retainer having an electrically conductive surface cathodically connected to a unidirectional current source while one or more of anodic electrodes connected to the current source may be juxtaposed with the conductive surface, the conductive surface, and the one or more of the anodes constituting the glow discharge electrodes.

As a result of controlling the discharge parameters $p$ and $d$ in the manner indicated, a stabilized glow discharge takes place at a reduced voltage and permitting a uniform ion bombardment over individual power particles located between the electrodes with high-energy positive gas ions formed in the discharge. The individual particle surfaces of powder in the fluidized state are thus treated uniformly and an enhanced processing efficiency is obtained.

Downstream of the treatment zone in the chamber there may be provided a receptacle for collecting the treated powder from the conveyor for removal from the chamber. The receptacle may be replaced by a compacting mold and then a press should be provided in the chamber for compacting a mass of the activated powder directly in the mold without exposure to air. When the mass is to be sintered, a known sintering arrangement is further provided in the chamber. The receptacle or mold is advantageously provided with a partition or covering which insures that the activated powder or sintered product may be removed from the chamber without destruction of the regulated atmospheric condition therein.

These and other features and advantages of the present invention will become apparent from the following description of embodiments thereof.

Figure 1:
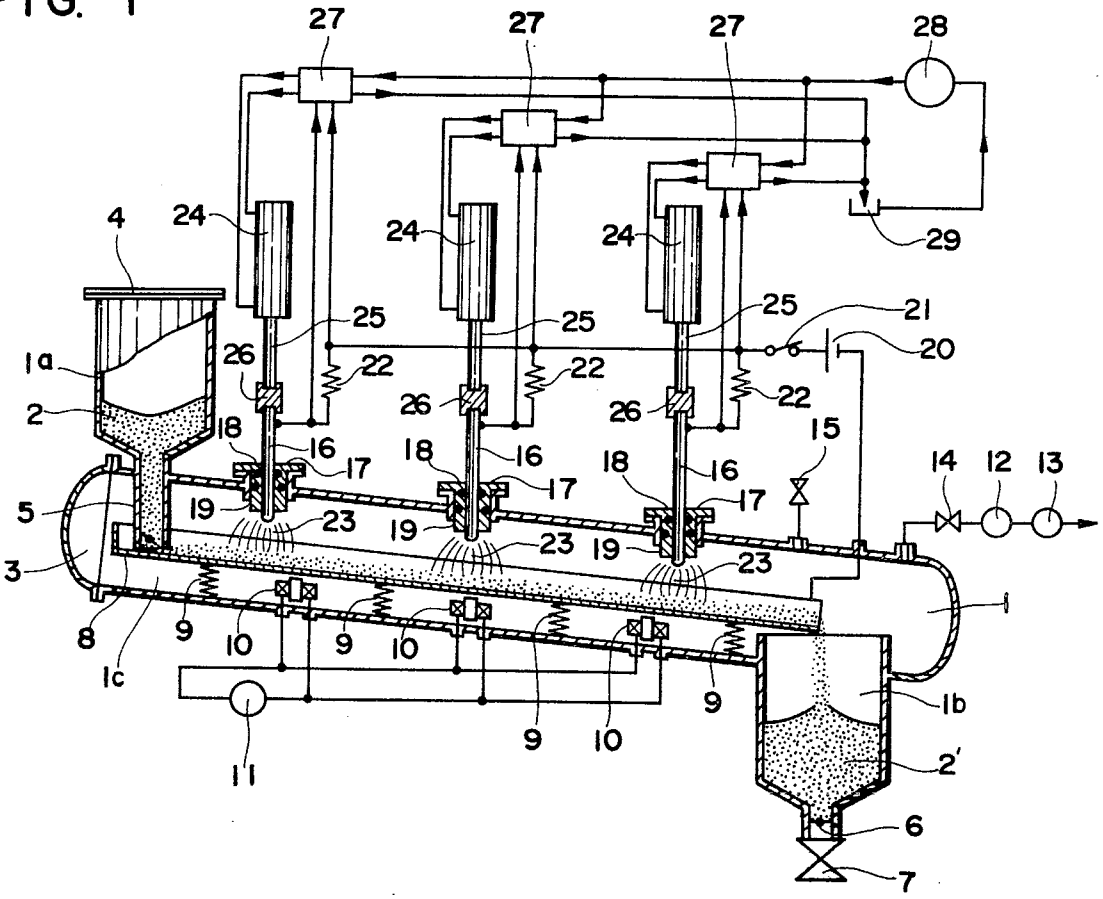
FIG. 1 is a diagrammatic view of a system embodying the invention, including a treatment chamber shown basically in section, a power supply and control arrangement.

The system shown in FIG. 1 comprises a treatment chamber 1 which has a supply hopper 1*a* for receiving powder to be treated 2, a receptacle 1*b* for collecting the powder treated 2 and a treatment compartment 1*c* tightly closed by a cap 3. The hopper 1*a* and the receptacle 1*b* are also tightly closed by a cover 4 and a check valve 7, respectively. Supported by springs 8 on the bottom of the compartment 1*c* is a vibratory conveyer 9, to which vibration is imparted by electromagnets 10 energized by a suitable power supply 11. The chamber 1 is also provided with an evacuating arrangement comprising a mechanical booster 12, a rotary vacuum pump 13 and a check valve 14. A vacuum breaking valve 15 is opened when the pressure in the chamber 1 is to be returned to the normal atmospheric level.

A plurality of anodes 10 are passed into the compartment 1*c* through insulators 17 and seal arrangements 18, 19 provided through the upper wall thereof to respectively juxtapose with the conveyer 8 surface. The latter is connected to the negative terminal of direct-current source 20 whose positive terminal is connected to each of the anodes 18 via a common switch 21 and each of resistors 22. Glow discharges taking place between the anodes 16 and the conveyer surface 8 or cathode are illustrated at 23.

The system further includes an apparatus for maintaining the distance between the anodes 16 and the cathode 8 at an optimum valve and controlling them in response to change in the pressure in the respective treatment zones. This apparatus comprises hydraulic cylinders 24 and their respective associated stems 25 which are in turn respectively coupled with anodes 16 by joints 26. The pressure-fluid flow into and out from the two compartments in each of the cylinders 24 to advance and retract the corresponding anode 16 is controlled by a hydraulic servo unit 27 associated with a pump 28 and fluid reservoir 29 and having an input leading from the resistor 22 in the discharge circuit.

In operation, the treatment compartment 1 is evacuated at a vacuum level in a range between $10^{-3}$ and 10 mm Hg and, conveniently, between $10^{-2}$ and 10 mm Hg, by the mechanical booster 12 and the vacuum pump 13. The vibratory conveyer 8 resiliently supported on the springs 9 is given vibration by the periodic energization of the electromagnets 10 with electric pulses supplied from the power supply 11. As a consequence, the powder 2 dropping from the hopper 1*a* on to the conveyer 8 is progressively transported toward the collector receptacle 1*b* while being tumbled thereon. In the operation of the system, of course, the shutter 5 is opened while the shutter 6 closed.

By closing the switch 21, a glow discharge is established between each of the anode rods 16 and the cathode conveyer 8. Streams of energistic positive gas ions formed in the glow discharge plasma will bombard the powder carried in the fluidized state by the conveyer 8 and knock out oxygen atoms in the oxide film on individual powder particle surfaces to fully activate the latter surfaces. Gaseous impurities separated from the powder are exhausted from the chamber 1 by the mechanical booster 12 and the pump 13. The amount of such generated gases is not always constant so that it may be difficult to maintain the pressure in the chamber 1 constant or at a desired vacuum. Variation in pressure leads to instable discharges with the result of variation in treatment performance. This variation or irregular ion bombardment may be overcome by controlling the distance $d$ between the anode 16 and the cathode 8 such that the product of the distance $d$ and the pressure $p$ is held at a predetermined value.

The variation in pressure $p$ can be ascertained by monitoring the magnitude of the glow discharge voltage or current which can be manifested by the potential difference appearing across the resistor 22. With an input derived from such parameter, the servo-control unit 27 operates the hydraulic cylinder 24 to control distance by advancing or retracting the anode 16 *d* so as to maintain the product *p·d* essentially constant. Owing to the stabilized discharge, uniform activation over the entire powder particles is achieved with an enhanced efficiency.

Although the power supply 20 may comprise a source of continuous direct current as illustrated, use of a pulse source is preferred; the potential may advantageously be applied in the form of a series of pulses across the electrodes. To this end, a capacitor charge and discharge type power supply or alternatively one in which the output of a direct-current source is intermittently interrupted by means of a switch may be employed. Such power supply instead of a continuous potential supply is advantageous in that it permits application of a higher voltage and reduces impediment of bombarding ions by powder dessociated impurity gases and prevents the powder and the anode 16 from being heated excessively.

In removing the powder 2' from the collector receptacle 1*b*, the shutter 5 is closed and the shutter 6 is opened while leaving the valve 7 closed, and thereafter the shutter 6 is reclosed. Then the valve 7 is opened to pack the powder 2' in the space below the closed shutter 6 into a suitable container. By repeating the alternate closure and opening of the shutter 6 and the valve 7, the powder 2' in the receptacle 1*b* is packed in a number of containers without destruction of the regulated atmospheric condition in the treatment chamber 1.

EXAMPLE I

Aluminum powder of a particle size of 200 mesh was treated in an evacuated atmosphere of *p* being about 0.1 mm Hg by exposing it to a glow discharge in a chamber (essentially as shown in FIG. 1). The distance *d* between the electrodes was about 1 cm and the product *p·d* was maintained at 0.1 mm Hg·cm with the continuous discharge voltage at 400 volts. The rate of treatment was 12 $cm^3$/minute. The treated powder could be sintered at a heating temperature as low as 320° C by a conventional sintering equipment into a dense coherent body of a density as high as 92%. When a pulsed potential was applied instead of the continuous potential in the glow discharge treatment, the discharge voltage was increased to 800 volts with the rate of treatment which could be triplicated.

Figure 2:
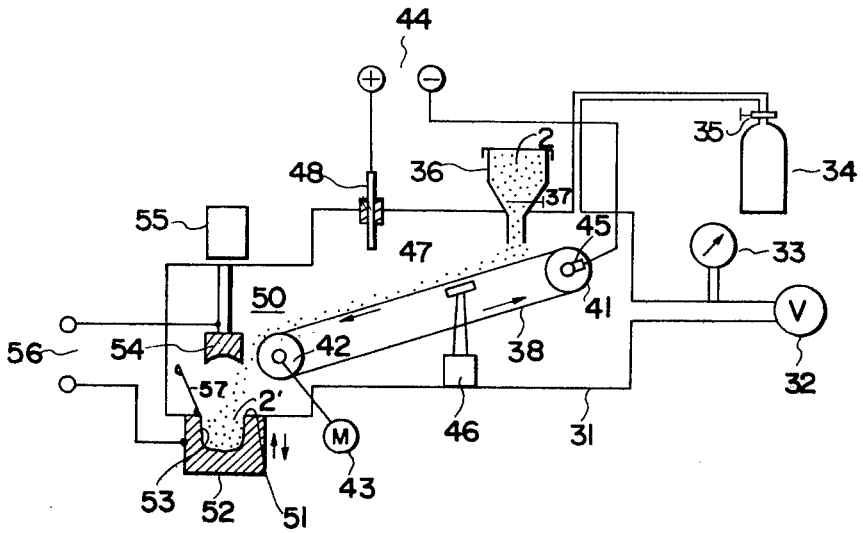
FIG. 2 is a diagrammatic view in section of an integrated powder activation and sintering system embodying the invention.

FIG. 2 represents an integrated powder activation and sintering system in which metallic powder is introduced into a controlled vacuum atmosphere and treated therein essentially as described in the previous embodiment, and thereafter sintered in the same atmosphere in a gas-tight common housing 31. Means for producing the controlled atmosphere in the housing 31 comprises a vacuum pump 32, a vacuum gauge 33 and in this embodiment further an inert gas supply 34 having a control valve 35. The valve 35 may be adapted to be operable manually or automatically in response to the indication of the vacuum gauge 33 to control the amount of entry of the inert gas into housing 31 so that a predetermined degree of vacuum may be maintained therein throughout the operation of the system.

In this system, the conveyer receiving powder 2 from a hopper 36 comprises an endless belt 38 carried by a pair of rollers 41 and 42, an idler roller and a drive roller rotated on their respective shafts, of which the latter is driven by a motor 43 to displace the belt 38 in the direction of the arrows. The belt 38 is electrically connected to the negative terminal of a unidirectional-current source 44 via a brush arrangement 45 provided on the part of the idler roller 41. A vibrator device 46 is provided here again to impart vibration to the conveyer 38 to hold the power 2 transported thereon through a treatment zone 47 in a fluidized state. In the treatment zone 47 an anodic electrode 48 is juxtaposed with the moving belt or cathode 38 and connected to a positive terminal of the power supply 44 to establish a glow discharge between the anode 48 and the cathode 38 thereby subjecting the powder fluidized in the zone 47 to bombardment with kinetically energized ions produced in the discharge as in the previous embodiment. As already indicated, the power supply 44 may be a source of continuous direct current but is preferably a source of DC pulses. Gaseous impurities separated from the powder are continuously withdrawn from the treatment zone 47 by the vacuum pump 32 and a fresh inert gas may be continuously introduced from the supply 34 into the housing 31 to hold the atmosphere therein under optimum condition. The hopper 36 is provided with a valve 37 which is held open until a predetermined amount of powder has been supplied to the treatment zone 47, the amount being determined by the dimension of a sintered product desired.

In accordance with the important feature of the invention, the positioning of the anode 48 and the adjustment of the evacuation control system 32, 33 and 34 are effected such that the product *p·d* is held in a range between $10^{-2}$ and 10 mm Hg·cm where *p* is the pressure of the atmosphere and *d* is the distance between the anode and the cathode as has been described. Further, as in the embodiment of FIG. 1, the anode 48 may be made displaceable and a servo-control unit provided to vary the distance *d* in compensation with change in the pressure *p* to maintain their product at a predetermined value.

Downstream of the treatment zone 47 in the housing 31 there is a compartment 50 consitituting the sintering chamber. The compartment 50 is shown having an aperture 51 through the bottom wall thereof, in flush with which is matingly positioned a movable die 52 having a die cavity 53 open into the compartment 50 for receiving the treated powder 2' from the moving belt 38. Here, a hermetic seal is provided to insure a fluid-tight mating between the die 52 and the compartment 50. Disposed above the die cavity 53 is a punch 54 carried by a press cylinder 55 for compressing a mass of the powder 2' loaded in the die cavity 53. In the embodiment illustrated, the punch 54 and the die 52 are connected in circuit with a power supply 56 for applying an electric heating current directly through the mass of powder in the die 52. The compression and heating may be effected simultaneously. The heating current may be a DC or a commercial AC and is preferably a DC upon which is superimposed a high-frequency AC. The latter type of power supply in the electric sintering system is advantageous in that it insures a uniform passage of heating current over the entire mass.

Shown pivotably mounted on the edge of the aperture 51 is a shutter plate 57 which is held open for the loading and sintering operations. After a single sintering operation is completed with the punch 54 retracted to the uppermost position, the shutter plate 57 is closed to cut communication between the compartment 50 and the die cavity 53. Then the die 52 may be displaced downwardly to a collecting position where the sintered mass in the die 52 may be removed therefrom.

Figure 3:
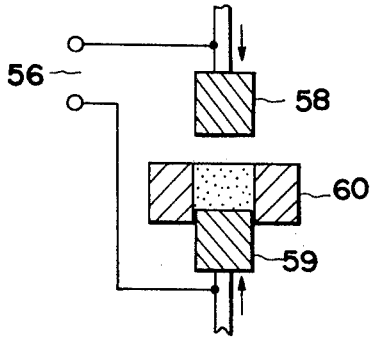
FIGS. 3, 4 and 5 are diagrammatic views of different sintering die and punch arrangements shown in section, also illustrating different heater arrangements, which may be used in the sintering stage according to the invention.

FIG. 3 shows a modified die and punch arrangement for producing sintered products of a columnar shape and which makes use of a pair of punches 58 and 59 and a cylindrical die 60 for receiving activated powder 2' and the punches therein. In the sintering operation, the lower punch 59 is first introduced into the die 60 to receive the powder 2' from the moving belt 38 and then the two punches 58 and 59 are both driven to displace in the approaching direction and compress the powder between them in the die 60.

Figure 4:
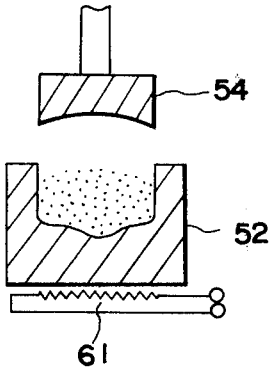
Figure 5:
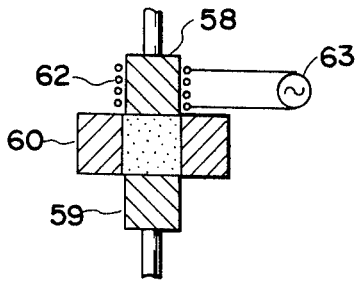

FIG. 4 shows a different heating arrangement for sintering, using an electric heater 61 provided on the side of the die 52 outside of the compartment 50 in FIG. 2. In the arrangement of FIG. 5, the heater makes use of an induction coil wound on one of punches 58 and energized by a high-frequency AC power source 63.

Owing to the advantages of the invention, the sintering temperature and time can be reduced markedly compared with conventional sintering practices.

EXAMPLE II

To obtain a sintered magnet, powder of samarium-cobalt alloy ($Sm_2Co_{17}$) of 300 mesh was introduced into a controlled atmosphere of 1 mm Hg argon, using an apparatus essentially shown in FIG. 2. A series of pulses of a potential of 600 volts and a pulse duration of 50 microseconds were applied at a frequency of 10 KHz between electrodes spaced at a distance of 5 cm in a treatment zone through which the powder was displaced. The powder in the displacement received discharge energy at 3 coulombs/50 cc and thereafter was loaded into a die. Therein sintering was carried out in a magnetic field of 1500 Oersted and using a compaction pressure of 80 tons/cm$^2$ at a temperature of 350° C. The time required for sintering was about 33 seconds and the sintered mass had a maximum energy product of $22.8 \times 10^6$ Gauss-Oersted.

Figure 6:
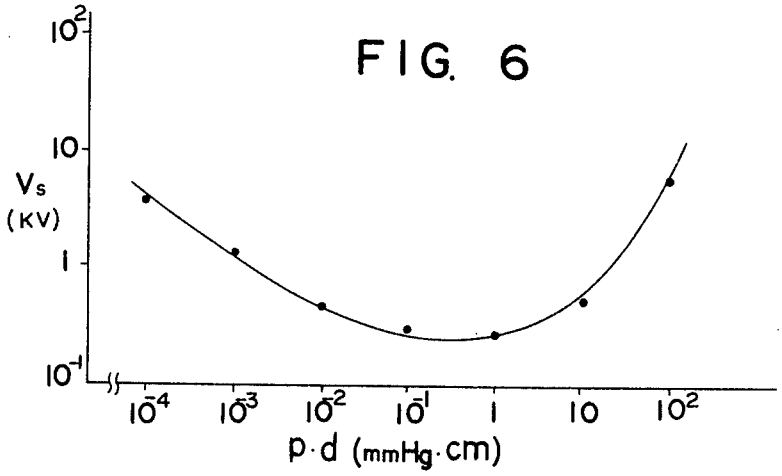
FIG. 6 is a graphical diagram for explanation of the invention and showing breakdown voltage versus the product of atmospheric pressure and inter-electrode distance.

In FIG. 6 is shown a curve of a breakdown voltage Vs in Kv plotted with respect to the product of pressure $p$ of the atmosphere in mm Hg and distance $d$ between the electrodes in cm. This curve is derived from Paschen's law and illustrates a minimum breakdown voltage range appears in a range of the product $p \cdot d$ between $10^{-2}$ and 100 mm Hg·cm and the curve is relatively flat in such range. The present invention is based upon the recognition that when the pressure times distance product is regulated to lie in that range, not only is the breakdown voltage reduced but the stability in glow discharge is increased such that uniformity and efficiency in ion bombardment treatment over a given amount of powder are substantially increased. Further, to this end, the value of $p$ may be in a range between $10^{-3}$ and 10 mm Hg and, preferably, between $10^{-2}$ and 10. The value of $d$ may be in a range between $10^{-1}$ and $10^4$ cm and is practically between $10^{-1}$ and $10^2$ cm.

The individual particles of powder may contain varying amounts of impurities and different thicknesses of an oxide film. The system of FIG. 7 which is shown again comprising an integrated system similar to that of FIG. 2 incorporates an adaptive control function whereby a substantially constant particle activation result may be obtained over the entirely of a given powder. More particularly, the adaptive control function in this embodiment is designed to monitor the impurities emitted from powder moving in the activation zone and to control the discharge power per area or discharge energy per (time × area) of the glow discharge effected to the moving powder.

Figure 7:
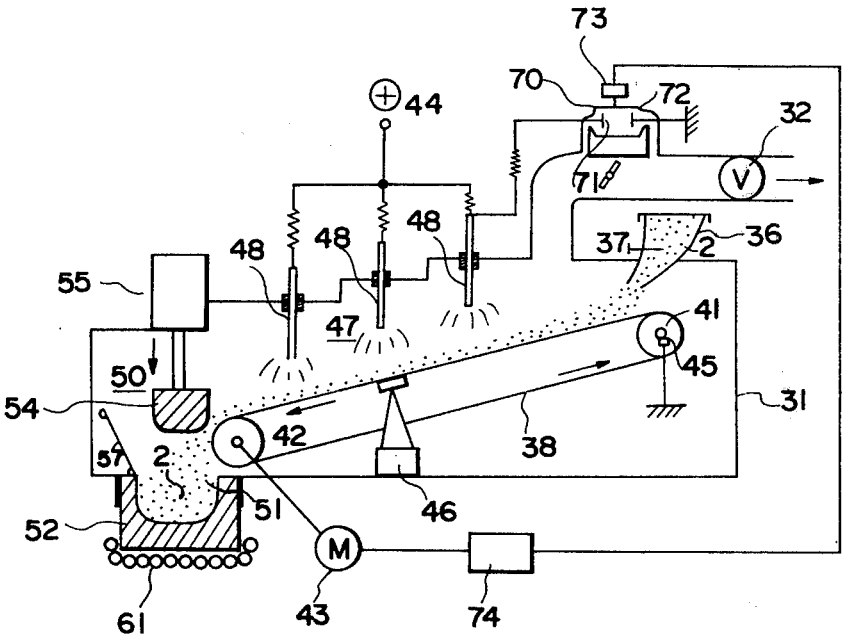
FIG. 7 is a diagrammatic view in section of an integrated system similar to that of FIG. 2, including a further control arrangement.

Thus, the system of FIG. 7 additionally includes a Geissler's tube 70 provided in a shunt of the exhaust duct 69 of the chamber 31 for receiving a fraction of the gases emitted from the treatment zone 47. The Geissler tube 70 as energized is adapted to produce a discharge illumination between a pair of electrodes 71 and 72 therein. As well known, the discharge illumination can be spectrum-analyzed to indicate the kinds and the amounts of gases contained in the tube. A detector unit 73 is, therefore, provided for spectrum-analyzing the illumination in the tube 70 to produce a signal indicative of the amount of gases therein or impurities which are emitted from the powder activation zone 47. The output of the detector unit 73 is connected to a converter circuit 74 for transforming the detected signal into a control signal for controlling the motor 43 to change the rate of the displacement of the moving belt 38 in response to said detected signal so as to adaptively control the discharge power per area of the glow discharge in the zone 47.

Alternatively, the detected signal indicative to the amount of impurities emission may be used to control the discharge power which can be modified by altering the product of the atmospheric pressure and the electrode distance and thus altering either or both of these variables. Furthermore, the discharge illumination between the treatment electrodes 48 and 38 can directly be spectrum-analyzed for the same purposes. Eventually, any measuring means capable of responding to change in the amount of gaseous emission may be substituted for the embodiments illustrated and described.

Figure 8:
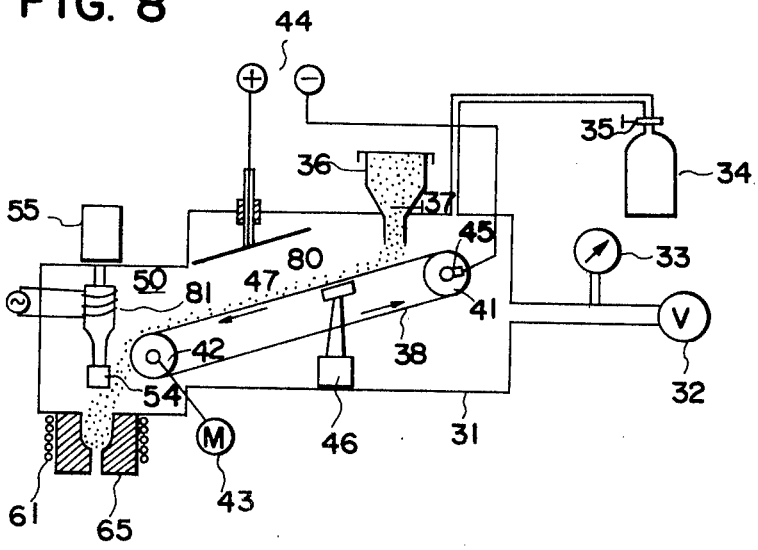
FIG. 8 is a diagrammatic view in section of a modified form of the integrated system according to the invention.

The integrated system shown in FIG. 8 is again similar to those previously described and includes a planar anode 80 in the treatment stage and an extruding die 65 and a press arrangement including the punch 54 and an ultrasonic horn 81 attached thereto in the sintering state. This press arrangement is found to be advantageous especially for compaction and sintering of powder mass immediately following the activation so that sinter-extruded bodies of an increased density can be obtained at a high speed.

EXAMPLE III

Iron powder for sinter-extrusion through a die of a diameter of 38 mm was treated in an argon atmosphere of a vacuum of 5 mm Hg by subjecting the same to glow discharges at a frequency of 400 Hz. The treated powder was progressively transported and directly loaded in the die. The loaded powder mass was extruded through the die with a pressure of 3 tons/cm$^2$ and an ultrasonic vibration of 150 watts superimposed thereon. There resulted a sintered body of 15 mm long and 38 mm dia. with a density of 92%.

Figure 9:
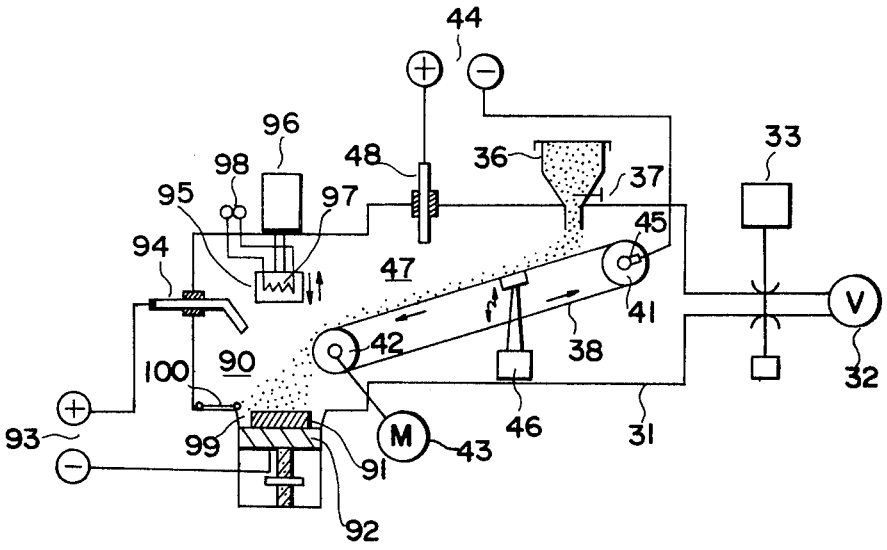
FIG. 9 is a similar view illustrating a further modified form of the invention which provides an integrated activation and sinter-bonding system for applying a sintered powder to a workpiece.

FIG. 9 represents an integrated powder activation and sinter-bonding system having an activation stage which is indentical or similar to those in the previous embodiments and a sinter-bonding stage in which a metallic workpiece or substrate 91 to be sinter-bonded is mounted on an electrically conductive plate 92 which is connected to the negative terminal of a DC source 93. An anodic electrode 94 connected to the positive terminal of the DC source 93 is amounted above the workpiece 91 which forms the cathodic electrode. Also mounted above the workpiece 91 is a ram 95 movably supported by a press cylinder 96 and having a heater coil 97 embedded therein. The heater coil 97 is energized by a power supply 98 to produce heat required for sintering. The plate 92 and the workpiece 91 are movably received in a chamber 99 separable from the compartment 90 directly thereabove by a shutter 100 of the type previously described.

Prior to receiving powder 2°, activation treatment is applied to the surface of the workpiece 91 by effecting glow discharge between the anode 94 and the cathodic workpiece 91. The glow discharge is here essentially of the type produced between the anode 48 and the moving cathode 38 in the powder activation zone 47. The result is a modification of the workpiece to a surface throughly cleaned from oxide film, moisture and other impurities and highly activated. Then the powder activated 2' is allowed to come from the conveyer belt 38 and spread over the treated substrate 91 to a given thickness. The press cylinder 96 is actuated to bring the ram 95 in contact with the powder on the substrate 91 under pressure and the heater 97 in the ram 95 is energized to produce sintering heat. Since both the substrate 91 and the powder 2' are highly activated, only a moderate heat is sufficient to sinter the powder together and bond it to the substrate 91.

EXAMPLE IV

Tungsten powder of 300 mesh was sinter-bonded to a molybdenum workpiece. The workpiece was pretreated by producing between it and an anode in an evacuated atmosphere a glow discharge at a potential of 1 kilovolt and of a current magnitude of 15 milliamperes with the product of the atmospheric pressure $p$ and the electrode distance $d$ being 5 mm Hg·cm for 3 minutes. The tungsten powder was pretreated by subjecting it to glow discharge of 2 kilovolts and 10 milliamperes with the above same $p \cdot d$ product on a moving belt imparted a vibration at 60 Hz with a time period of treatment of 10 minutes. The treated powder was evenly spread over the treated molybdenum workpiece with a thickness of 1.2 mm and was sinter-bonded thereto with a compaction pressure of 4 tons/cm$^2$ and sintering heat at a temperature of 220° C. The time required for sinter-bonding was 20 seconds and the sinter-bonded layer had a bond strength of 4.2 kg/cm$^2$.

Figure 10:
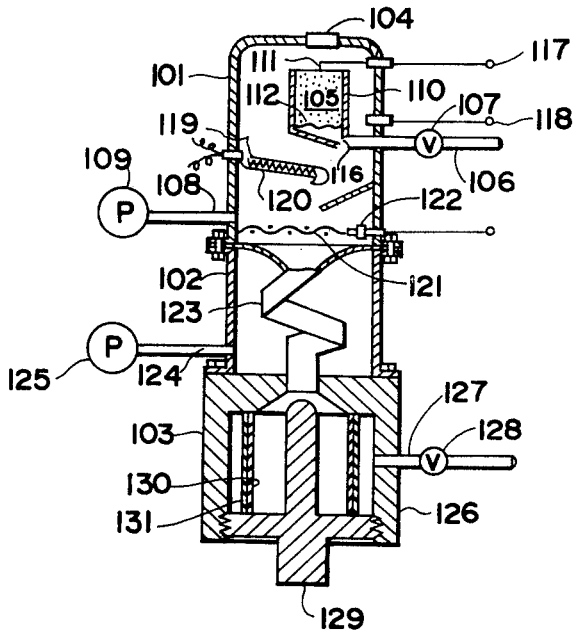
FIG. 10 is a diagrammatic view in elevation and in section of another form of the integrated system also embodying the principles of the invention.

FIG. 10 represents another form of the integrated activation and powder-loading system, according to the present invention. The system essentially comprises three parts: an activation treatment chamber 101, an evacuation chamber 102 and a powder compacting unit 103. The powder compaction unit 103 in this case is shown to employ a so-called rubber press, although the system is adapted to any type of compaction or sintering process.

The activation chamber 101 is provided with a raw-material inlet 104, through which unactivated powder 105 is introduced, a gas inlet 106 with a valve 107 for delivering an inert or reductive atmosphere into the chamber 101, and a gas evacuating duct 108 communicating with a vacuum pump 109. A discharge treatment zone 110 is provided with a needle electrode 111 and a screen electrode 112 for exposing the fluidized powder 105 of raw material to corona and/or glow discharge in the manner described hereinbefore, while inert gas comes in through the conduit 116. For this purpose, terminals 117 and 118 are supplied with any suitable discharge power supply but a supply of pulses is preferred as described earlier.

After treatment by electron and ion bombardment in the zone 110, the powder 105 is fed to a heating stage 119, at which contamination, if nay, remaining on the particles can be removed by heat emanating from a heater 120. Thereafter, the treated powder is fed to a vibrating screen 121, preferably equipped with a sonic or ultrasonic vibrator 122, which preferably sets up a frequency ranging from 100 Hz. to 200 kHz. the vibrating screen 121 forms means for separating contaminated or decomposed substances from the particles and also serves as a filtering means. The filtered-out particles and the decomposed and separated gaseous substances are then evacuated through the duct 108 by the vacuum pump 109. In this connection, the pressure within the activation chamber 102 can be reduced to $10^{-2}$ to $10^{-5}$ mm Hg without decreasing activation efficiency.

Disposed under the vibrating screen 121 is a feeder tube 123, preferably having a spiral configuration, through which the activated powder is progressively fed. A conduit 124 may communicate with a vacuum pump 125 to keep the zone 102 also at a low pressure. The feeder 123 is preferably made porous, so that the powder passing therethrough may be completely degassed by the negative pressure in the zone 102 applied via the conduit 124. The lower end of the conduit 124 introduces the powder into the compaction unit 103.

The unit 103 in this instance may comprise an external vessel 126 provided with a fluid inlet 127 having a valve 128. A mandrel 129 forms a solid die, and one or more deformable membranes 130 and 131 form another die. The membranes 130 and 131 may be composed of natural rubber, synthetic rubber or other elastomeric material and, alternatively, may be deformable but non-elastic material. Upon sufficient loading of the powder that has been cleaned and activated in accordance with the present invention, hydraulic or pneumatic fluid may be introduced through the inlet 127 into the cavity formed by the side wall 126, the die 129 and the deformable membranes 130 and 131, to compress the loaded powder substantially isostatically.

I claim:

1. Apparatus for purifying and compacting metallic powder, comprising a treatment vessel, powder purifying apparatus in the upper portion of said vessel having means for supplying and maintaining a non-oxidizing atmosphere in said vessel and means for bombarding the powder with high energy particles chosen from the class consisting of sub-atomic particles, ions, and molecules, means for dropping the powder after bombardment toward the lower end of the vessel, means for degassing the falling powder, and a compacting mold into which the powder falls.

2. The apparatus of claim 1 wherein the means for bombarding comprises a pair of electrodes and means for applying across said electrodes a pulsed potential sufficient to effect a glow discharge between said electrodes.

3. The apparatus of claim 1 having additional means for bombarding said powder after degassing as it falls into said mold.

4. An activated sintering apparatus comprising: an evacuable gas-tight chamber for receiving a rarefied gas non-oxidizing atmosphere therein, conveyer means for receiving a supply of metallic powder thereon and passing the same in a fluidized state through and beyond a treatment zone, at least a pair of electrodes in said chamber for producing a glow discharge at said treatment zone so as to subject said powder to bombardment with energistic ions in said discharge thereby cleaning and activating said powder, means for maintaining the distance between said pair of electrodes at a value such that the product of the pressure of said atmosphere and said value, in mm Hg times cm, is in a range between $10^{-2}$ and 10, support means downstream of said treatment zone for receiving the activated powder in the form of a mass from said conveyer means, associated with said support means for compacting said activated means powder and means for heating the compacted mass to sinter it into a coherent body.

5. The apparatus of claim 4, further comprising means for maintaining the pressure in said chamber at $10^{-3}$ to 10 mm Hg.

6. The apparatus of claim 5 wherein said conveyer means has an electrically conductive surface supporting said powder in its fluidized state, cathodically connected to a unidirectional current source and spacedly juxtaposed with at least one anode connected to said source, said surface and said anode constituting said pair of electrodes.

7. The apparatus of claim 6 wherein said unidirectional current source is a source adapted to provide a pulsed potential.

8. The apparatus of claim 6 wherein said conveyer means comprises an endless belt and means for imparting vibration to the moving endless belt.

9. The apparatus of claim 6, further comprising means responsive to the pressure of said atmosphere for controlling the distance between said pair of electrodes.

10. The apparatus of claim 6, further comprising means responsive to the amount of emission of impurities cleaned from said powder particle surfaces for controlling rate of movement of said conveyer means through said treatment zone.

11. The apparatus of claim 6 wherein said support means holds a workpiece to be plated with said powder, further comprising second glow discharge means for subjecting said workpiece to bombardment with energistic ions to clean and activate its surface prior to receipt of said powder thereon and means for heating said workpiece and said activated powder during compacting to sinter-bond the mass to said workpiece.

12. The apparatus of claim 6 wherein said support means includes a mold for receiving said activated powder.

13. The apparatus of claim 12, further comprising means for applying a supersonic wave energy to said powder being compacted.

14. The apparatus of claim 4, further comprising powder inlet means for introducing the power into said chamber, outlet means for removal of the sintered body out from said chamber and seal means enabling the sintered body to be removed without destructing the regulated atmospheric condition within said chamber.

15. An apparatus for activating metallic powder to improve its purity and clean its surfaces from oxide film, moisture and other impurities so that it becomes more chemically active and also is able to form denser blocks upon compacting or sintering, comprising an evacuable gas-tight chamber for receiving a rarefied gas non-oxidizing atmosphere therein, vacuum pump means for maintaining the pressure of said atmosphere in said chamber in a range between $10^{-3}$ and 10 mm Hg, conveyer means in said chamber for receiving a supply of metallic powder thereon and transporting the same in a fluidized state through and beyond a treatment zone, at least a pair of electrodes juxtaposed in said treatment zone, means for maintaining the distance between said juxtaposed electrodes at such a valve that the product of said pressure of the atmosphere and said value, in mm Hg times cm, is in a range between $10^{-2}$ and 10, power supply means connected across said juxtaposed electrodes for establishing a glow discharge therebetween such that said powder is subjected to bombardment with energistic ions in said discharge thereby being cleaned and activated, and means downstream of said treatment zone for collecting the activated powder from said conveyer means.

16. The apparatus of claim 15 wherein said power supply means is a power supply capable of providing a pulsed potential.

17. The apparatus of claim 15 wherein said conveyer means comprises an electrically conductive surface poled cathodic connected to said power supply means.

18. The apparatus of claim 17 wherein the apparatus comprises a plurality of anodes commonly connected to said power supply means and each juxtaposed with said cathodic conductive surface.

19. The apparatus of claim 15 wherein said conveyer means includes a moving belt and means for imparting vibration to said moving belt.

20. The apparatus of claim 15, further comprising means responsive to the amount of emission of impurities separated from said powder particle surfaces for controlling the rate of movement of said conveyer means through said treatment zone.

21. The apparatus of claim 20, further comprising means responsive to the pressure in said chamber for controlling the distance between said electrodes in accordance therewith.

22. The apparatus of claim 15, further comprising inlet means for introducing the powder into said treatment chamber, means for removing the collected activated powder from said conveyer means and seal means for enabling said collected condition within said chamber.

* * * * *

UNITED STATES PATENT AND TRADEMARK OFFICE

CERTIFICATE OF CORRECTION

PATENT NO. : 4,005,956

DATED : February 1, 1977

INVENTOR(S) : Kiyoshi Inoue

It is certified that error appears in the above-identified patent and that said Letters Patent are hereby corrected as shown below:

Column 2, lines 13-14, "co-mounds" should read --compounds--

Column 6, line 8, "power 2" should read --powder 2--

Column 9, line 10, "powder 2°" should read --powder 2'--

Column 12, line 22, which is line 16 of claim 15, "valve" should read --value--

Item [73] in left-hand column of first page, the name of the assignee should be --Inoue-Japax Research Incorporated--

Signed and Sealed this

Nineteenth Day of April 1977

[SEAL]

*Attest:*

RUTH C. MASON
*Attesting Officer*

C. MARSHALL DANN
*Commissioner of Patents and Trademarks*